US006616259B2

(12) United States Patent
Sasayama

(10) Patent No.: US 6,616,259 B2
(45) Date of Patent: Sep. 9, 2003

(54) INK JET PRINTING METHOD

(75) Inventor: Hiroyuki Sasayama, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/066,697

(22) Filed: Feb. 6, 2002

(65) Prior Publication Data

US 2002/0158932 A1 Oct. 31, 2002

(30) Foreign Application Priority Data

Feb. 7, 2001 (JP) ..... P. 2001-031149

(51) Int. Cl.[7] ..... B41J 2/205
(52) U.S. Cl. ..... 347/15
(58) Field of Search ..... 347/15, 43, 19; 358/3.14, 3.07

(56) References Cited

U.S. PATENT DOCUMENTS 4,827,352 A * 5/1989 Yoneda et al. ..... 358/3.07
4,910,603 A * 3/1990 Hirahara et al. ..... 358/3.14
5,287,209 A 2/1994 Hiratsuka et al.
5,953,459 A * 9/1999 Ueda et al. ..... 382/237

FOREIGN PATENT DOCUMENTS

JP 0 899 943 A2 3/1999

OTHER PUBLICATIONS

European Search Report dated Jun. 12, 2002.

* cited by examiner

*Primary Examiner*—Thinh H Nguyen
(74) *Attorney, Agent, or Firm*—Sughrue Mion, PLLC

(57) ABSTRACT

An ink jet printing method comprising forming an ink image directly on a printing medium according to image data signals and fixing the image to obtain printed matter, in which tone reproduction is based on conversion of density levels of the image data into sizes of ink dots, wherein a tone conversion table is prepared based on at least five characteristic curves representing the relationship of tone values versus energy for forming the ink dots, at least three characteristics curves are prepared each at a prescribed tone value in the half tone range, each having a converted energy value other than the maximum and minimum converted energy values, and the number of dots the converted energy for which is substantially the minimum is a half or more than a half of the total number of the dots at a tone value that is the least of tone values having a dot the converted energy for which is substantially the maximum.

9 Claims, 9 Drawing Sheets

FIG. 5

MAIN SCANNING DIRECTION 600dpi

BK

SUBSCANNING DIRECTION 1200dpi

| | | | |
|---|---|---|---|
| 1 | X | 16 | X |
| X | 12 | X | 8 |
| 13 | X | 4 | X |
| X | 5 | X | 9 |
| 3 | X | 14 | X |
| X | 10 | X | 16 |
| 15 | X | 2 | X |
| X | 7 | X | 11 |

FIG. 6

MAIN SCANNING DIRECTION 600dpi

C

SUBSCANNING DIRECTION 900dpi

| | | | |
|---|---|---|---|
| 1 | X | 4 | X |
| X | 7 | X | 10 |
| 5 | X | 2 | X |
| X | 11 | X | 8 |
| 3 | X | 6 | X |
| X | 9 | X | 12 |

FIG. 7

MAIN SCANNING DIRECTION 600dpi

M (&Y)

SUBSCANNING DIRECTION 600dpi

| | | | |
|---|---|---|---|
| 1 | X | 5 | X |
| X | 3 | X | 7 |
| 6 | X | 2 | X |
| X | 8 | X | 4 |

INK JET PRINTING METHOD

FIELD OF THE INVENTION

This invention relates to a printing method of forming an image directly on a printing medium.

BACKGROUND OF THE INVENTION

Printing methods for forming an image on a printing medium based on image data signals include an electrophotographic system, a sublimating dye transfer or thermofusible transfer system, and an ink jet system. An electrophotographic system involves a process of forming an electrostatic latent image on a photoreceptor (drum) by electrification and exposure, which requires a complicated system, making the apparatus expensive. The apparatus for a thermal transfer system is inexpensive but has a high running cost and produces waste because of use of an ink ribbon. On the other hand, an ink jet printer is inexpensive and has a low running cost with efficient use of ink because ink is directly ejected only to necessary areas of a printing medium.

The ink jet system includes a piezoelectric system, a thermal jet system, an electrostatic system, and a Spark jet system as described, e.g., The Society of Electrophotography of Japan (ed.), Imaging, Part 2, Latest Hard Copy Printing Technology, ch. 3, Shashin Kogyo Shuppansha (1988) and Kokado Shiroshi (ed.), Kiroku Kiroku Gijutsu Handbook, Maruzen Co., Ltd. (1992). Applications or combinations of these systems, such as those disclosed in JP-A-10-175300 (the term "JP-A" as used herein means an "unexamined published Japanese patent application"), JP-A-6-23986, JP-A-5-131633, JP-A-10-114073, JP-A-10-34967, JP-A-3-104650, and JP-A-8-300803, are also used suitably.

The disadvantages of an ink jet printing method resides in that distortion of dot contour due to feathering or positional deviation of dots readily result in image deficiency or unevenness and that the printing speed is slow because of involvement of mass transfer in printing.

In order to improve the printing speed, it has been attempted to reduce resolution while maintaining the requisite number of tone levels by varying dot size through control of drop volume, ejection time, and the like.

For the purpose of solving the problem ascribed to positional deviation of dots, an image forming system which achieves tone reproduction by varying dot size has been proposed as disclosed, e.g., in JP-A-9-1866. According to this system, an image is segmented into a plurality of blocks, input/output characteristics corresponding to the pixel positions are varied among the blocks. For each of the blocks the density levels of image data are converted to density levels of dots to be recorded, and the position at which dots of a size are to be recorded is varied and dispersed among the blocks. As a result, the image structure is prevented from being perceived with the naked eye so as to suppress generation of a moire pattern.

SUMMARY OF THE INVENTION

The above-described conventional technology is, in principle, a kind of pseudo area coverage modulation technology using a multi-level dither method, which has only limited discrete density levels. Its concept consists in that regularity of dot configuration (size and position) is minimized to make the image structure less perceptible with the naked eye and to reduce undesirable moire patterns.

In more detail, R, G and B brightness data are converted into density data of three primary colors of printing, C, M and Y. Black component generation and under color removal are carried out based on the density data to obtain C, M, Y, and Bk (black) data. The C, M and Y data are then subjected to correction processing such as masking and then to tone processing together with the Bk data. In the tone processing the pixels at each position in the above-described block are divided into, for example, odd number lines and even number lines, and different tone conversion table characteristics are applied to each of them.

According to this technique, however, because the characteristics of the tone conversion tables are monotonous, resulting prints unavoidably suffer from graininess where low density recording pixels are formed on a white background. Although the system proposed is used with assumption that printing substrates have stable characteristics, considerations should be given to application to printing substrates that cannot be, in fact, seen as always stable in characteristics. In the case of ink jet printing, the percent change of dot size due to, for example, ink spread or feathering that depends on the humidity and surface roughness of the printing substrate increases with decrease of dot size, which results in a subtle change of the printed image. While feathering hardly occurs as far as elaborated image information, such as data from photographs, is printed on paper for the exclusive use, ink jet printers fail to form high quality images on ordinary printing paper or non-absorbing printing media such as plastic sheets.

Additionally, an ink jet printing system is apt to produce errors of dot positioning. Particularly with small dots, the influence of the errors on dot area unevenness will be exaggerated. Therefore, image unevenness attributed to dot positional deviation is readily allowed to manifest in a low density area made of small dots in a printed image.

An object of the present invention is to provide an ink jet printing method which uses an image formation technique effective for obtaining a high quality image and which is applicable to a printing medium that is not always seen as stable in characteristics.

The present invention provides an ink jet printing method comprising forming an ink image directly on a printing medium according to image data signals and fixing the image to obtain printed matter, in which tone reproduction is based on conversion of density levels of the image data into dot sizes, wherein tone conversion tables are prepared based on at least five characteristics curves representing the relationship of tone values versus energy for forming recording dots, at least three characteristics curves are prepared each at a prescribed tone value in the half tone range, each having a converted energy value other than the maximum and minimum values, and the number of recorded dots the converted energy for which is substantially the minimum is a half or more than a half of the total number of the recorded dots at a tone value that is the least of tone values having a recorded dot the converted energy for which is substantially the maximum.

In preferred embodiments of the printing method, at least three periods are used for sub scan (sub-scanning) for the respective printing colors, and the positions of recording dots are varied for the respective printing colors; or the relationship between a plurality of dots in a unit block and the tone conversion characteristic curve for at least one color varies among blocks. This one color is preferably the one having the lowest density, i.e., yellow.

The present invention also provides an ink jet printing method based on the above-mentioned tone reproduction system, wherein:

monochromatic images of at least two colors have different numbers of elements per unit block, and the unit blocks for the two or more colors are equal in width and length.

In preferred embodiments of the present invention, monochromatic images of at least two colors have different numbers of elements per unit block, the relationship between a plurality of dots in a unit block and the tone conversion characteristic curve varies among blocks for each of the two or more colors, and the unit blocks of the two or more colors are equal in width and length.

It is preferred that one out of four colors except the above-described three colors is a color having the lowest density, i.e., yellow.

According to the present invention, a continuous gradation of tone is obtained by the image formation method in which at least five tone conversion characteristic curves representing the relationship of tone values versus energy for recording dot formation are prepared for preparing tone conversion tables, and there are at least three converted energy values in addition to the maximum and minimum values at a prescribed tone value in the half tone range. Further, even where recording dots of low density are formed on a white background, image graininess is markedly reduced by setting number of recorded dots the energy for which is substantially the minimum at a half or more than a half of the total number of recorded dots at a tone value that is the least of those having a recorded dot the energy for which is substantially the maximum.

Use of the term "substantially the maximum" with respect to recorded dot forming energy implies that the energy of the characteristic curve at the highest tone value is higher than the energy at any other tone value for every color, which is effective in improving flatness in a solid image area.

BRIEF DESCRIPTION OF THE DRAWINGS

FIG. 5 is a matrix of a Bk image.

FIG. 6 is a matrix of a C image.

FIG. 7 is a matrix of an M image.

DETAILED DESCRIPTION OF THE INVENTION

Figure 1:
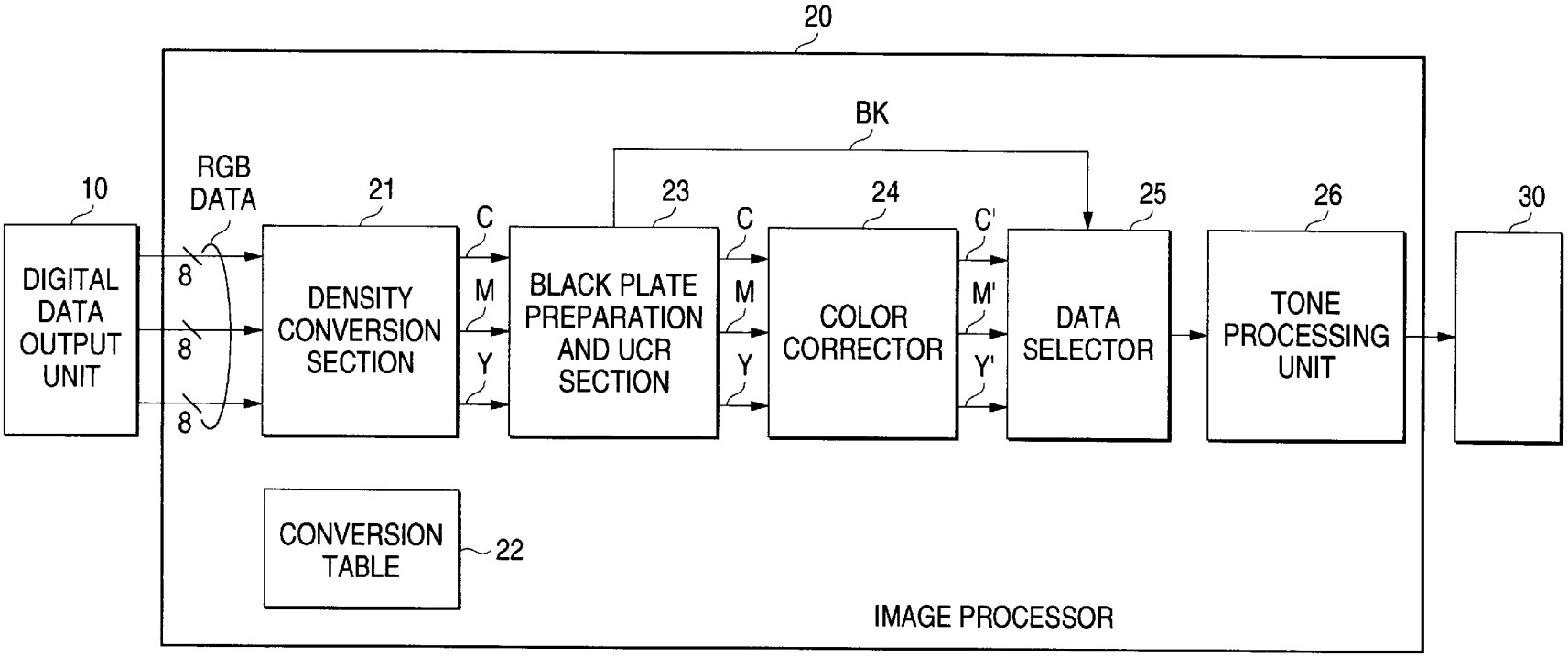
FIG. 1 is a block diagram of an image forming apparatus which can be used to carry out the image forming method adopted in the ink jet printing method of the invention.

The present invention will be described with reference to its preferred embodiments by referring to the accompanying drawings. FIG. 1 is a block diagram of a color image forming apparatus which can be used to materialize the image formation method adopted in the ink jet printing method of the invention. The color image forming apparatus shown is composed of a digital data output section 10, an image processing section 20, and an ink jet printing section 30. The data to be processed in the image processing section 20 are 8 pits for R, G and B each, totaling to 24 bits, per pixel.

The image processing section 20 has a density convertor 21, conversion tables 22, a unit 23 for black component generation and under color removal (UCR), a color corrector 24, a data selector 25, and a tone processing unit 26. On starting up the ink jet printing section 30, digital image data are outputted from the digital data output section 10 to the image processing section 20.

The image data (R, G and B brightness data) inputted into the image processing section 20 are converted into density data for each of cyan (C), magenta (M) and yellow (Y), which are three primary colors for printing, by use of the conversion tables 22 in the density convertor 21. The C, Y and M density data are sent to the unit 23, where UCR and black component generation are executed to output C, M, Y, and Bk (black) density data.

The C, M, and Y density data are inputted to the color corrector 24, where masking or a like processing is executed. In FIG. 1, the thus processed C, M, and Y density data are indicated by symbols C', M', and Y', respectively. The C', M', Y', and Bk density data are forwarded to the data selector 25, where data of a color are selected and inputted to the tone processing unit 26.

The tone processing unit 26 introduces a screen angle into the input data for preventing moire patterns and converts the input data into special density values by use of a tone conversion table hereinafter described. Being conventional, the processing for introducing a screen angle for moire prevention is not described here in detail. The conversion processing by use of a tone conversion table will be discussed in detail.

Figure 2:
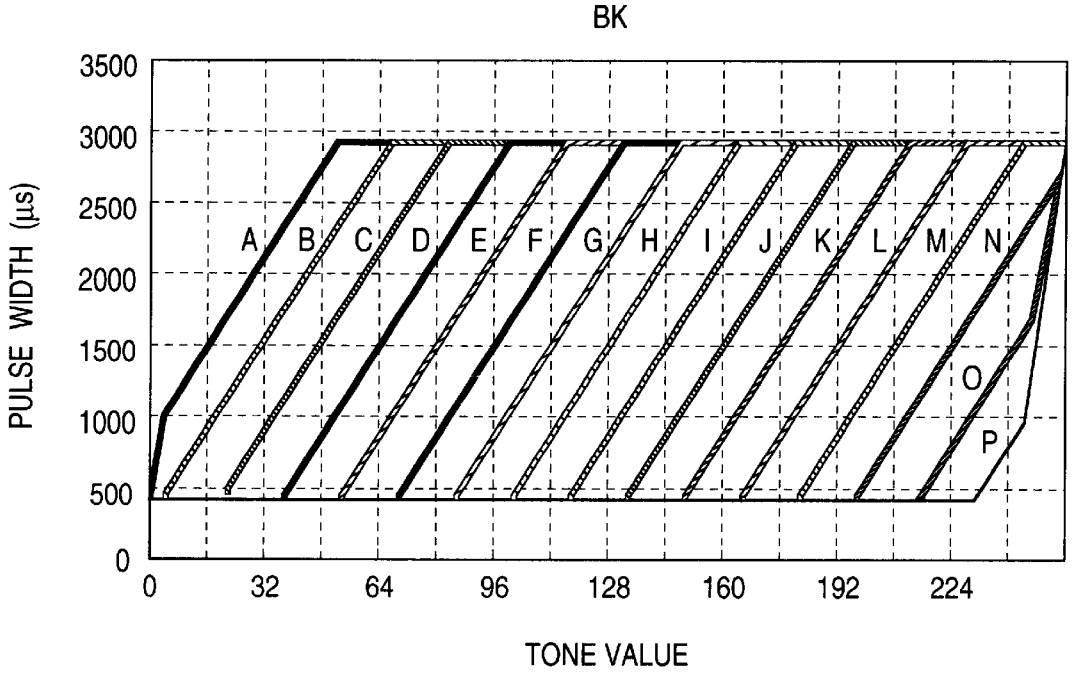
FIG. 2 shows conversion characteristics (Bk) for a tone conversion table.
Figure 3:
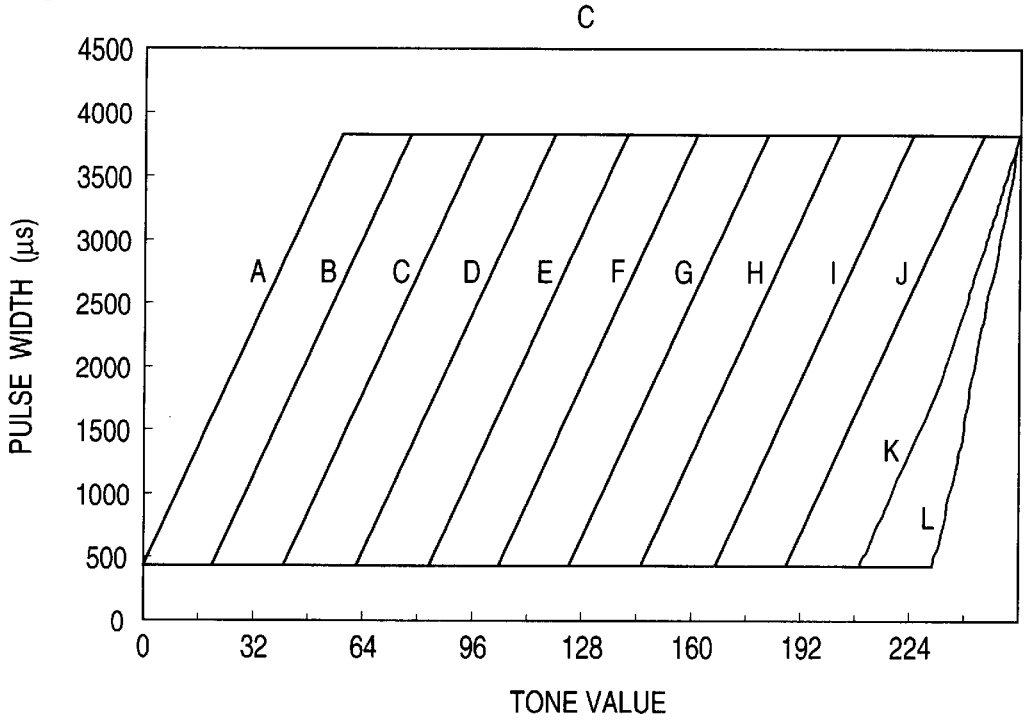
FIG. 3 shows conversion characteristics (C) for a tone conversion table.
Figure 4:
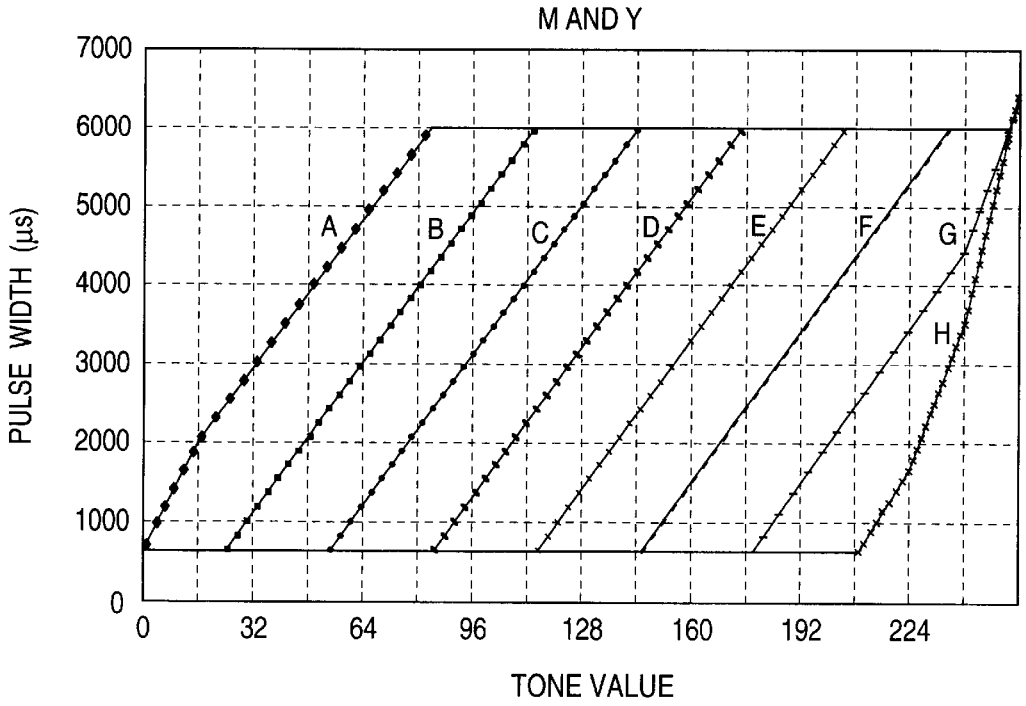
FIG. 4 shows conversion characteristics (M) for a tone conversion table.

FIGS. 2 through 4 present examples of tone conversion characteristics of Bk, C, and M and Y, respectively. The tone of inputted image is plotted in abscissa, and the recording pulse width (time) in the ordinate. The recording pulse width corresponds to the size of recording dots. The inputted image has 256 levels (0 to 255) of tone.

In FIGS. 2 to 5, the tone conversion characteristics are represented by at least five characteristic curves each showing the relationship of tone value of inputted image vs. energy for generating recording dots. Specifically, FIG. 2 has 16 curves from A to P; FIG. 3, 10 curves from A to J; FIG. 4, 8 curves from A to H. Each curve indicates dot growth from the threshold energy (the bottom of each curve).

In FIGS. 2 to 4, the tone conversion characteristics in the half tone range are represented by at least three characteristic curves at prescribed tone values, the three or more characteristic curves each having energy values other than the maximum and minimum energy values. The energy at the highest tone value (255) is set slightly higher than at the other tone values (by 190 μs in FIG. 2, 220 μs in FIG. 3, and 300 μs in FIG. 4). As a result, flatness in a solid image area is improved.

Further, at a tone value that is the least of those having a dot the energy for which is substantially the maximum, the number of recorded dots the energy for which is substantially the minimum is a half or more than a half of the total number of recorded dots at that tone value.

FIGS. 5 to 7 are each a matrix (unit block) showing which conversion curve is to be selected from a plurality of energy conversion curves. FIG. 5 is a matrix of Bk; FIG. 6, of C; and FIG. 7, of M. These matrices are equal in width and length but have different numbers of dots because of differences in sub scan resolution. Tone conversion is executed in accordance with the tone conversion characteristics defined by the relative positional relationship in each block. Thereafter, different pulse widths are allotted to the individual converted tone values, and the energy to be applied to each recorded dot in each unit block is decided.

In each matrix, all the elements "X" are recorded dots whose tone requires almost no energy application, and the numbers "1", "2", "3" . . . are recorded dots corresponding to the characteristic curves A, B, C . . . of FIGS. 2 to 4. The resolution in the main scan (the main scan) direction is 600 dpi, and that in the sub scan (sub-scan) direction is 1200 dpi (Bk), 900 dpi (C) and 600 dpi (M and Y). The size of the matrix (horizontals×verticals) is 4×8 (Bk), 4×6 (C) and 4×4 (M and Y). Taking for instance the Bk matrix having a sub scan resolution of 1200 dpi, where 150 blocks are built per inch, each unit block containing 4×8=32 dots, there is a possibility that 32 maximum tone conversion characteristic curves are necessary. However, because there are recorded dots which can be converted according to the same tone conversion characteristic curve, 17 kinds of tone conversion characteristics are allotted for 32 recorded dots with agreement between the number "1", "2", "3", . . . of the matrix and the symbols "A", "B", "C", . . . in FIG. 2. This manner of allotment (hereinafter referred to as an unequivocal allotment) also applies to the C and M matrices. In the Y matrix, the eight kinds of tone conversion characteristics of FIG. 4 were allotted to the elements 1 to 8 at random.

Although the Y matrix is equal to the M matrix in size (4×4) and resolutions (main scan: 600 dpi; sub scan: 600 dpi), the positions of the elements other than "X"are randomly different among all the Y matrices so that the characteristic curves are decided as for the whole Y image. With the matrix size and resolution for each color being set as described above, matrices on an image are of a size, not given in number of the elements but in dimensions in a real space, irrespective of color.

In this way, a large number of tone/recorded dot energy conversion (tone conversion) characteristic curves are prepared, and, in a half tone range, three or more tone values are allotted for recorded dots of mid-energy value (energy value except the maximum and the minimum). As a result, continuity of tone can be obtained easily and stably.

Conditions for building matrices are described below.

Bk Matrix:

1. Sub scan resolution conversion: 600 dpi/1200 dpi Nearest-neighbor correction (resolution of nearest pixels in sub scan direction: 128 or more tones) and linear interpolation (resolution of nearest pixels in sub scan direction: less than 128 tones) are applied to convert 600 dpi original data into 1200 dpi.
2. Size: 4×8 (horizontals×verticals)
3. Number of recorded dots per block: 32
4. Tone conversion characteristic curves: A to P
5. Allotment of tone conversion characteristic curves to recorded dots: unequivocal
6. Tone conversion: 256 tones/64 tones Original 256 tone levels are converted into 64 tone levels according to a conversion table.
7. Allotment of pulse widths: 64 tone levels are each allotted a pulse width according to a conversion table.

C Matrix:

1. Sub scan resolution conversion: 600 dpi/900 dpi Nearest-neighbor correction (resolution of nearest pixels in sub scan direction: 128 or more tones) and linear interpolation (resolution of nearest pixels in sub scan direction: less than 128 tones) are applied to convert 600 dpi original data into 900 dpi.
2. Size: 4×6 (horizontals×verticals)
3. Number of recorded dots per block: 24
4. Tone conversion characteristic curves: A to L
5. Allotment of tone conversion characteristic curves to recorded dots: unequivocal
6. Tone conversion: 256 tones/128 tones Original 256 tone levels are converted into 128 tone levels according to a conversion table.
7. Allotment of pulse widths: 128 tones are each allotted a pulse width according to a conversion table.

M Matrix:

1. Sub scan resolution conversion: no conversion (600 dpi)
2. Size: 4×4 (horizontals×verticals)
3. Number of recorded dots per block: 16
4. Tone conversion characteristic curves: A to H
5. Allotment of tone conversion characteristic curves to recorded dots: unequivocal
6. Tone conversion: 256 tones/128 tones Original 256 tone levels are converted into 128 tone levels according to a conversion table.
7. Allotment of pulse widths: 128 tone levels are each allotted a pulse width according to a conversion table.

Y Matrix:

1. Sub scan resolution conversion: no conversion (600 dpi)
2. Size: 4×4 (horizontals×verticals)
3. Number of recorded dots per block: 16
4. Tone conversion characteristic curves: A to H
5. Allotment of tone conversion characteristic curves to recorded dots: Recorded dots 1 to 8 are randomly allotted the tone conversion characteristic curves randomly.
6. Tone conversion: 256 tones/128 tones Original 256 tone levels are converted into 128 tone levels according to a conversion table.
7. Allotment of pulse widths: 128 tone levels are each allotted a pulse width according to a conversion table.

Figure 8:
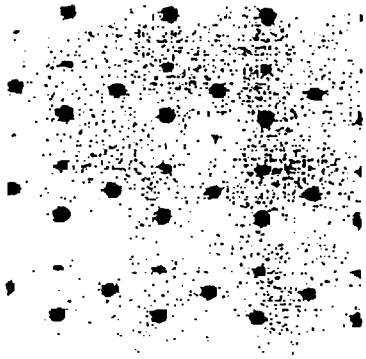
FIG. 8 shows enlarged recording dot patterns of Bk in a highlight.
Figure 8:
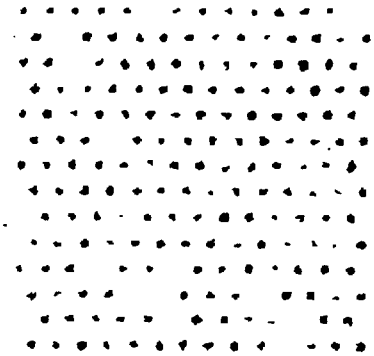
Figure 9:
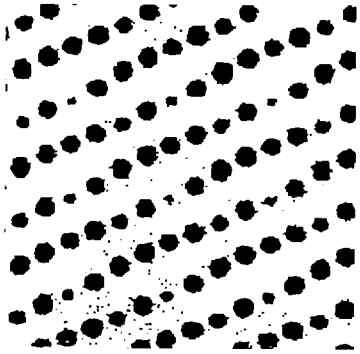
FIG. 9 shows enlarged recording dot patterns of Bk in a half-tone.
Figure 9:
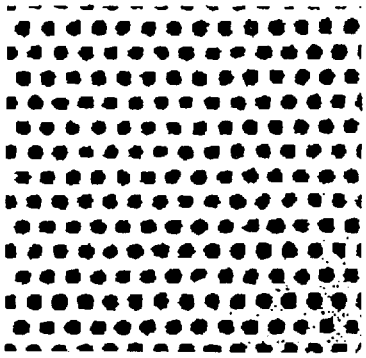
Figure 10:
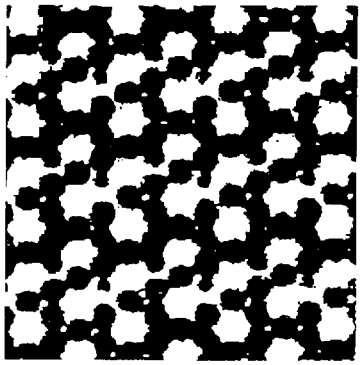
FIG. 10 shows enlarged recording dot patterns of Bk in a shadow.
Figure 10:
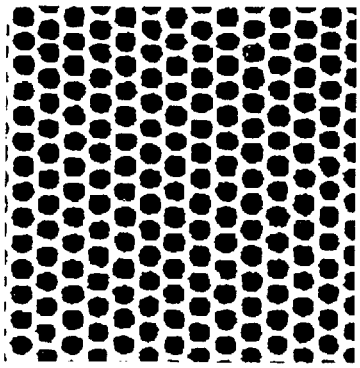

The tone processing by the tone processing unit 26 will be described with reference to FIGS. 8 through 10. FIGS. 8 to 10 are enlarged recording dot patterns of Bk in a highlight (64), a half-tone (128) and a shadow (192), respectively, in which (a) present recorded dots according to the above-described embodiment of the invention, and (b) conventional ones.

In FIG. 8(*a*), because a highlight is reproduced by a smaller number of dots than in FIG. 8(*b*), wherein a size of each of the dots in FIG. 8(*a*) is mainly larger than that in FIG. 8(*b*), dot missing, which is likely to occur in highlights, is less outstanding. As a result, even when pixels of low density are formed on a white background, image graininess can be avoided, and improved reproducibility is secured.

Another embodiment of conversion by use of tone conversion tables will be illustrated with reference to FIGS. 11 through 14 which show tone conversion characteristics of Bk, C, M, and Y, respectively. The tone of inputted image is plotted in abscissa, and the recording pulse width (time) in the ordinate. The recording pulse width corresponds to the size of recorded dots. The inputted image has 256 levels (0 to 255) of tone.

Figure 11:
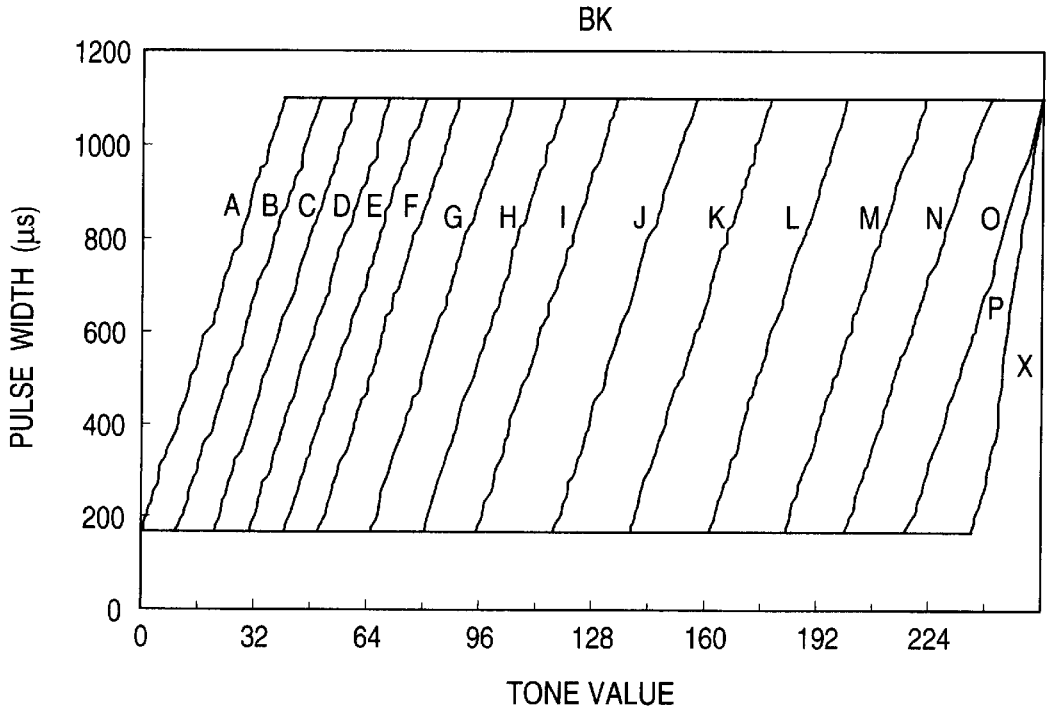
FIG. 11 shows another kind of conversion characteristics (Bk) for a tone conversion table.
Figure 12:
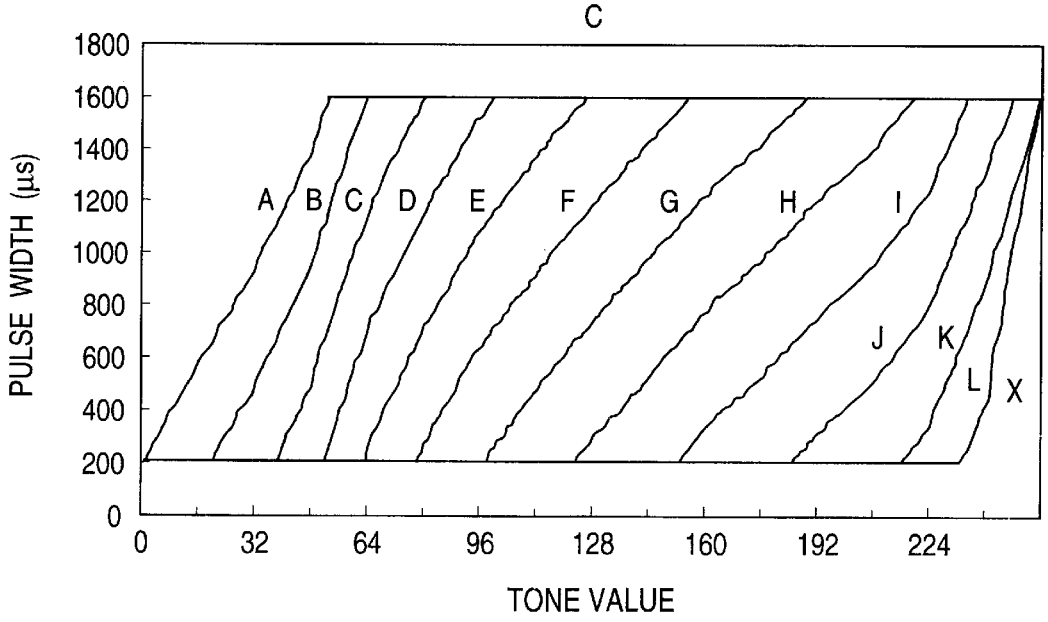
FIG. 12 shows another kind of conversion characteristics (C) for a tone conversion table.
Figure 13:
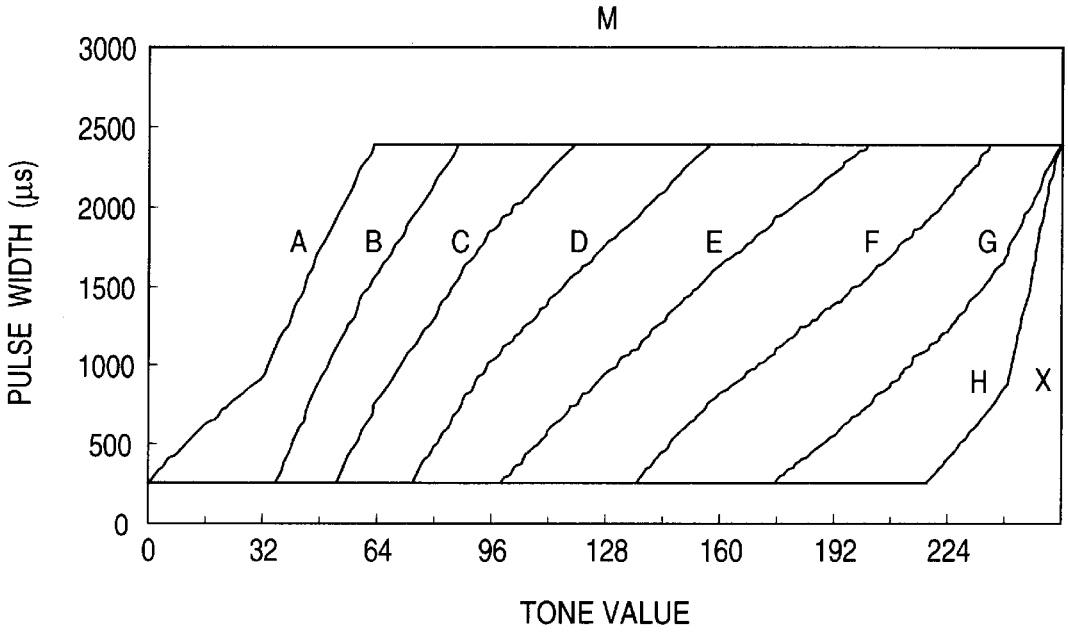
FIG. 13 shows another kind of conversion characteristics (M) for a tone conversion table.
Figure 14:
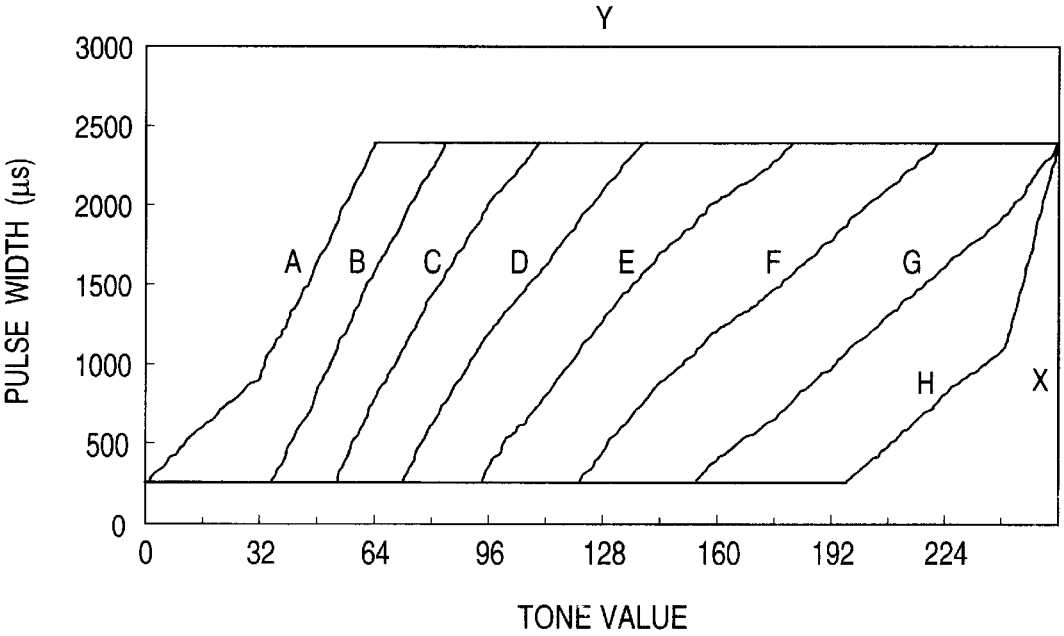
FIG. 14 shows another kind of conversion characteristics (Y) for a tone conversion table.

Similarly to those shown in FIGS. 2 to 4, the tone conversion characteristics are specified by at least five conversion characteristic curves for each color which show the relationship of tone value of inputted image vs. energy for generating recording dots, i.e., 17 lines (A to P and X) in FIG. 11, 13 lines (A to L and X) in FIG. 12, and 9 lines (A to H and X) in FIGS. 13 and 14. The curves X are allotted to the elements "X" in the respective color matrices shown in FIGS. 5 to 7 such that a predetermined amount of energy is applied only for the maximum tone value (255).

The difference from the Bk, C, M and Y tone conversion characteristics shown in FIGS. 2 to 4 resides in the pitch of the characteristic curves. That is, the curves have an increasing interval from highlight toward shadow areas.

The tone conversion characteristics shown in FIGS. 11 to 13 are allotted for the matrices shown in FIGS. 5 to 7. In allotting the tone conversion characteristics of Y to the matrix M (& Y) of FIG. 7, the characteristics X are allotted to the elements "X" unequivocally, whereas the characteristics A to H are allotted at random to the elements other than "X".

Figure 15:
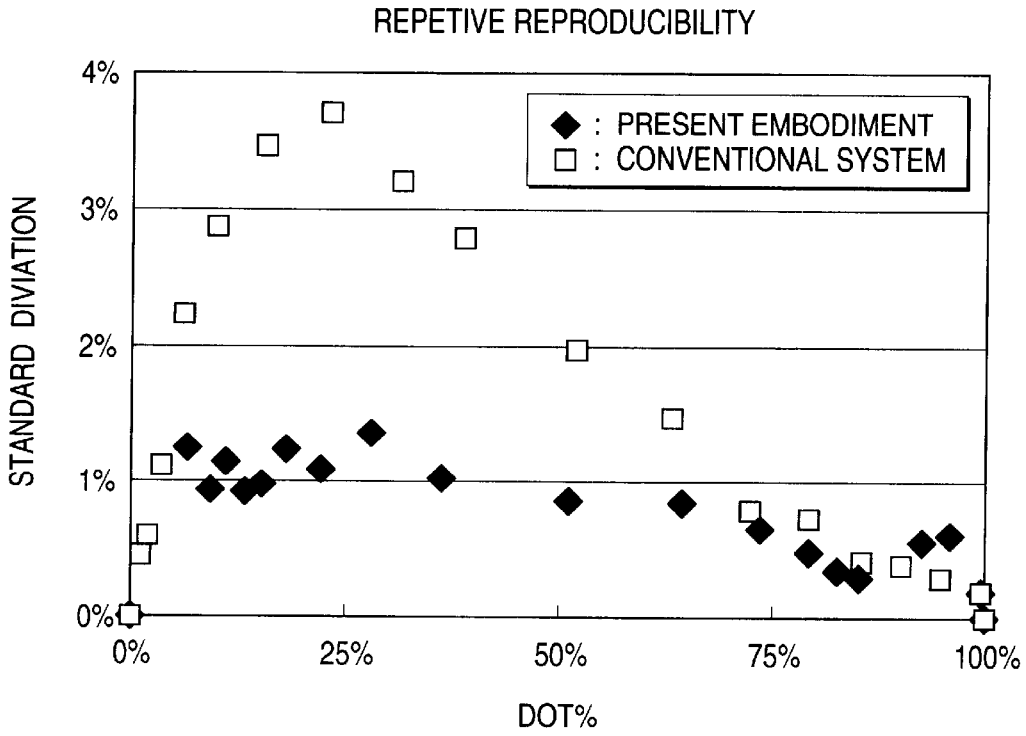
FIG. 15 is a graphical representation of repeatability of tone reproduction.

FIG. 15 is a graphical representation of density reproduction with the recording dots according to the present invention (Example) and with conventional dots (Comparison) in repeatedly printing a highlight-to-shadow image, in which an average density is plotted as abscissa and a standard deviation as ordinate. It is seen that the prints of Example have a small standard deviation, proving the printing method of the invention to have high repeatability of tone reproduction.

While the embodiments of the invention have been described predominantly with reference to Bk, the same applies to C, M and Y. Where colors are overprinted to reproduce a multicolor image, it is preferred that the sub scanning periods be varied among the colors so that the positions of recorded dots may be varied among the colors. As a result, the tone continuity is improved, and color misregistration, if any, can be made less perceptible by the naked eye.

Japanese Patent 2608808 discloses an image forming system which is relevant to the present invention. The Patent teaches an example in which four characteristic curves are used in the tone conversion table, and two characteristic curves each having an energy level other than the maximum and the minimum values are set in the half tone range. It turned out, however, that this example failed to provide tone continuity stably when a recording material with a thin ink-absorbing layer was printed. In other words, even though a tone jump in gradation could be controlled below a visible level at a certain temperature and a certain humidity by some specific image forming conditions, it has been confirmed that the tone jump exceeds the visible level when the temperature or humidity changes.

Hence, in the present invention, the tone conversion characteristics are specified by at least five characteristic curves, and the half tone range thereof are specified by at least three characteristic curves each having an energy value other than the maximum and minimum energy values. It has been confirmed that sufficient effects can be obtained as a result even where a recording material having a thin ink-absorbing layer is printed.

Conversion tables 1 for tone conversion and conversion tables 2 for pulse width allotment which are based on the tone conversion characteristics shown in FIGS. 11 to 14 are shown in Tables 1 through 8 below.

TABLE 1

Conversion Table 1 (Bk matrix)

| | X | A | B | C | D | E | F | G | H | I | J | K | L | M | N | O | P |
|---|---|---|---|---|---|---|---|---|---|---|---|---|---|---|---|---|---|
| 0 | 0 | 1 | 1 | 1 | 1 | 1 | 1 | 1 | 1 | 1 | 1 | 1 | 1 | 1 | 1 | 1 | 1 |
| 1 | 0 | 2 | 1 | 1 | 1 | 1 | 1 | 1 | 1 | 1 | 1 | 1 | 1 | 1 | 1 | 1 | 1 |
| 2 | 0 | 4 | 1 | 1 | 1 | 1 | 1 | 1 | 1 | 1 | 1 | 1 | 1 | 1 | 1 | 1 | 1 |
| 63 | 0 | 63 | 1 | 1 | 1 | 1 | 1 | 1 | 1 | 1 | 1 | 1 | 1 | 1 | 1 | 1 | 1 |
| 64 | 0 | 63 | 63 | 63 | 51 | 36 | 21 | 1 | 1 | 1 | 1 | 1 | 1 | 1 | 1 | 1 | 1 |
| 65 | 0 | 63 | 63 | 63 | 53 | 38 | 23 | 1 | 1 | 1 | | | 1 | 1 | | 1 | 1 |
| 127 | 0 | 63 | 63 | | | | 63 | 63 | 63 | 48 | 15 | 1 | 1 | 1 | 1 | 1 | 1 |
| 128 | 0 | 63 | 63 | 63 | 63 | 63 | 63 | 63 | 63 | 51 | 18 | 1 | 1 | 1 | 1 | 1 | 1 |
| 129 | 0 | 63 | 63 | 63 | 63 | 63 | 63 | 63 | 63 | | | | | | | | |
| 191 | | | | | | | | | 63 | 63 | 63 | 63 | 46 | 12 | 1 | 1 | 1 |
| 192 | 0 | 63 | 63 | 63 | 63 | 63 | 63 | 63 | 63 | 63 | 63 | 63 | 47 | 14 | 1 | 1 | 1 |
| 193 | 0 | 63 | 63 | 63 | 63 | 63 | 63 | 63 | | | | | 53 | 63 | 63 | | |
| 253 | | | | | | | | 63 | 63 | 63 | 63 | 63 | 63 | 63 | 63 | 59 | 55 |
| 254 | 0 | 63 | 63 | 63 | 63 | 63 | 63 | 63 | 63 | 63 | 63 | 63 | 53 | 63 | 63 | 61 | 60 |
| 255 | 48 | 63 | 63 | 63 | 63 | 63 | 63 | 63 | 63 | 63 | 63 | 63 | 63 | 63 | 63 | 63 | 63 |

TABLE 2

Conversion Table 2 (Bk matrix)

| Tone after Convention | Pulse Width (μs) |
|---|---|
| 0 | 0 |
| 1 | 170 |
| 2 | 185 |
| 15 | 380 |
| 16 | 395 |
| 17 | 410 |
| 31 | 620 |
| 32 | 635 |
| 33 | 650 |
| 61 | 1070 |
| 62 | 1085 |
| 63 | 1100 |

TABLE 3

Conversion Table 1 (C matrix)

| | X | A | B | C | D | E | F | G | H | I | J | K | L |
|---|---|---|---|---|---|---|---|---|---|---|---|---|---|
| 0 | 0 | 1 | 1 | 1 | 1 | 1 | 1 | 1 | 1 | 1 | 1 | 1 | 1 |
| 1 | 0 | 2 | 1 | 1 | 1 | 1 | 1 | 1 | 1 | 1 | 1 | 1 | 1 |
| 2 | 0 | 4 | 1 | 1 | 1 | 1 | 1 | 1 | 1 | 1 | 1 | 1 | 1 |
| 63 | 0 | | | 1 | 1 | 1 | 1 | 1 | 1 | 1 | 1 | 1 | 1 |
| 64 | 0 | 127 | 124 | 84 | 44 | 4 | 1 | 1 | 1 | 1 | 1 | 1 | 1 |
| 65 | 0 | 127 | 127 | 87 | 47 | 7 | 1 | 1 | 1 | 1 | 1 | 1 | 1 |
| 127 | 0 | 127 | 127 | | | | 87 | 47 | 7 | 1 | 1 | 1 | 1 |
| 128 | 0 | 127 | 127 | 127 | 127 | 127 | 68 | 48 | 8 | 1 | 1 | 1 | 1 |
| 129 | 0 | 127 | 127 | 127 | 127 | 127 | 89 | 49 | 9 | | | | |
| 191 | | | | | | | | | 89 | 49 | 9 | 1 | 1 |
| 192 | 0 | 127 | 127 | 127 | 127 | 127 | 127 | 127 | 90 | 50 | 10 | 1 | 1 |
| 193 | 0 | 127 | 127 | 127 | 127 | 127 | 127 | 127 | | | | | 106 |
| 253 | | | | | | | | 127 | 127 | 127 | 127 | 118 | 113 |
| 254 | 0 | 127 | 127 | 127 | 127 | 127 | 127 | 127 | 127 | 127 | 127 | 123 | 120 |
| 255 | 95 | 127 | 127 | 127 | 127 | 127 | 127 | 127 | 127 | 127 | 127 | 127 | 127 |

TABLE 4

Conversion Table 2 (C matrix)

| Tone after Convention | Pulse Width (μs) |
|---|---|
| 0 | 0 |
| 1 | 214 |
| 2 | 225 |
| 15 | |
| 16 | 379 |
| 17 | 390 |
| 31 | |
| 32 | 555 |
| 33 | 566 |
| 63 | 896 |
| 64 | 907 |
| 65 | 918 |
| 125 | 1578 |
| 126 | 1589 |
| 127 | 1600 |

TABLE 6

Conversion Table 2 (M matrix)

| Tone after Convention | Pulse Width (μs) |
|---|---|
| 0 | 0 |
| 1 | 258 |
| 2 | 275 |
| 15 | |
| 16 | 513 |
| 17 | 530 |
| 31 | |
| 32 | 785 |
| 33 | 802 |
| 63 | 1312 |
| 64 | 1329 |
| 65 | 1346 |
| 125 | 2366 |
| 126 | 2383 |
| 127 | 2400 |

TABLE 5

Conversion Table 1 (M matrix)

| | X | A | B | C | D | E | F | G | H |
|---|---|---|---|---|---|---|---|---|---|
| 0 | 0 | 1 | 1 | 1 | 1 | 1 | 1 | 1 | 1 |
| 1 | 0 | 2 | 1 | 1 | 1 | 1 | 1 | 1 | 1 |
| 2 | 0 | 4 | 1 | 1 | 1 | 1 | 1 | 1 | 1 |
| 63 | 0 | 122 | 74 | 26 | 1 | | 1 | | 1 |
| 64 | 0 | 125 | 77 | 29 | 1 | 1 | 1 | 1 | 1 |
| 65 | 0 | | | 31 | 1 | 1 | 1 | 1 | 1 |
| 127 | 0 | 127 | 127 | 127 | 87 | 39 | 1 | 1 | 1 |
| 128 | 0 | 127 | 127 | 127 | 89 | 41 | 1 | 1 | 1 |
| 129 | | | | | 90 | 42 | 1 | 1 | 1 |
| 191 | 0 | 127 | 127 | 127 | 127 | 113 | 65 | 17 | 1 |
| 192 | 0 | 127 | 127 | 127 | 127 | 114 | 66 | 18 | 1 |
| 193 | | | | | | 115 | 67 | 19 | |
| 253 | 0 | 127 | 127 | 127 | 127 | 127 | 127 | 121 | 115 |
| 254 | 0 | 127 | 127 | 127 | 127 | 127 | 127 | 124 | 121 |
| 255 | 96 | 127 | 127 | 127 | 127 | 127 | 127 | 127 | 127 |

TABLE 7

Conversion Table 1 (Y matrix)

| | X | A | B | C | D | E | F | G | H |
|---|---|---|---|---|---|---|---|---|---|
| 0 | 0 | 1 | 1 | 1 | 1 | 1 | 1 | 1 | 1 |
| 1 | 0 | 2 | 1 | 1 | 1 | 1 | 1 | 1 | 1 |
| 2 | 0 | 4 | 1 | 1 | 1 | 1 | 1 | 1 | 1 |
| 63 | 0 | 123 | 75 | 27 | 1 | | 1 | | 1 |
| 64 | 0 | 126 | 78 | 30 | 1 | 1 | 1 | 1 | 1 |
| 65 | 0 | | | 32 | 1 | 1 | 1 | 1 | 1 |
| 127 | 0 | 127 | 127 | 127 | 108 | 60 | 12 | 1 | 1 |
| 128 | 0 | 127 | 127 | 127 | 110 | 62 | 14 | 1 | 1 |
| 129 | 0 | | | | 111 | 63 | 15 | 1 | 1 |
| 191 | 0 | 127 | 127 | 127 | 127 | 127 | 90 | 42 | 1 |
| 192 | 0 | 127 | 127 | 127 | 127 | 127 | 92 | 44 | 1 |
| 193 | | | | | | 127 | 93 | 45 | |
| 253 | 0 | 127 | 127 | 127 | 127 | 127 | 127 | 123 | 117 |
| 254 | 0 | 127 | 127 | 127 | 127 | 127 | 127 | 125 | 122 |
| 255 | 96 | 127 | 127 | 127 | 127 | 127 | 127 | 127 | 127 |

TABLE 8

Conversion Table 2 (Y matrix)

| Tone after Convention | Pulse Width (μs) |
|---|---|
| 0 | 0 |
| 1 | 258 |
| 2 | 275 |
| 15 | |
| 16 | 513 |
| 17 | 530 |
| 31 | |
| 32 | 785 |
| 33 | 802 |
| 63 | 1312 |
| 64 | 1329 |
| 65 | 1346 |
| 125 | 2366 |
| 126 | 2383 |
| 127 | 2400 |

EXAMPLES

Example 1

Figure 16:
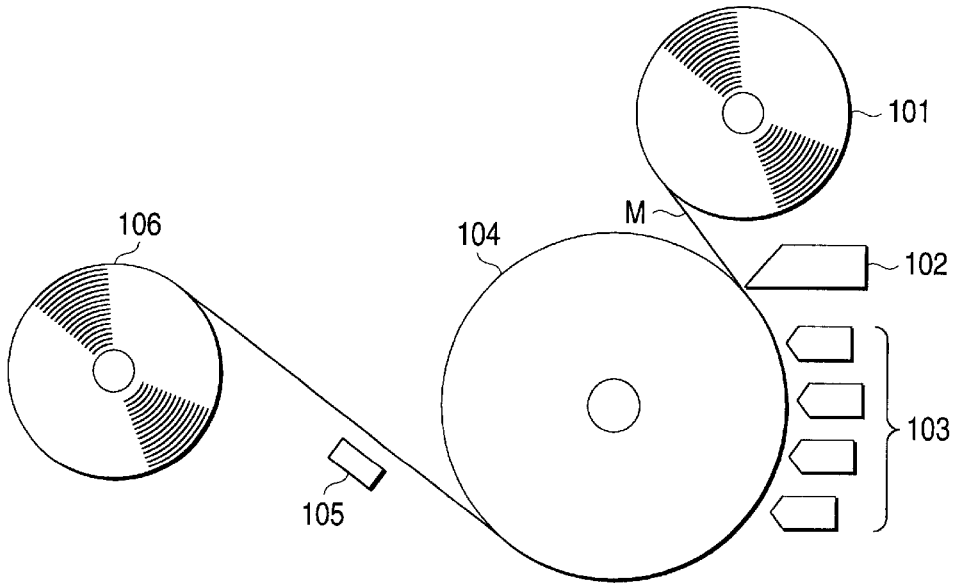
FIG. 16 schematically illustrates a printing apparatus for carrying out the ink jet printing method of the invention.

Ink jet printing was carried out using a web type printing apparatus shown in FIG. 16 having four ink ejectors 103 for the respective colors arrayed to conduct overprinting on the same side of a printing medium M which is transported on a rotating drum 104. The apparatus of FIG. 16 additionally had a printing medium feed roll 101, a dust removing member 102, a fixing member 105, and a take-up roll 106. A shear-mode 500-channel piezo ink-jet (Xaar Jet 500S) was mounted on the apparatus as the ink ejectors 103. Oil inks available from Xaar were used. The gap was adjusted to 0.8 mm with a Teflon roller. Image data to be printed were sent to an image data computation control, and the 500-channel ink ejector heads ejected ink simultaneously onto the printing medium M while revolving the facing drum 104 to obtain 500 prints. The imaging resolution was 360 dpi, and tone was reproduced by using eight dot sizes. As a result, imaging defects due to dust or influences of external temperature change were not observed at all. As the number of prints increased, the dot diameters showed changes that were not so great as to produce influences. Even after printing 5,000 times, extremely clear full color prints free from dot missing or scratches were obtained.

After completion of the printing test, the nozzles of the ejector heads were wiped off with nonwoven paper, and a cover was put on the printing apparatus. After being kept in this state for 3 months with no maintenance, the printing apparatus was able to resume printing to produce satisfactory prints.

Example 2

Figure 17:
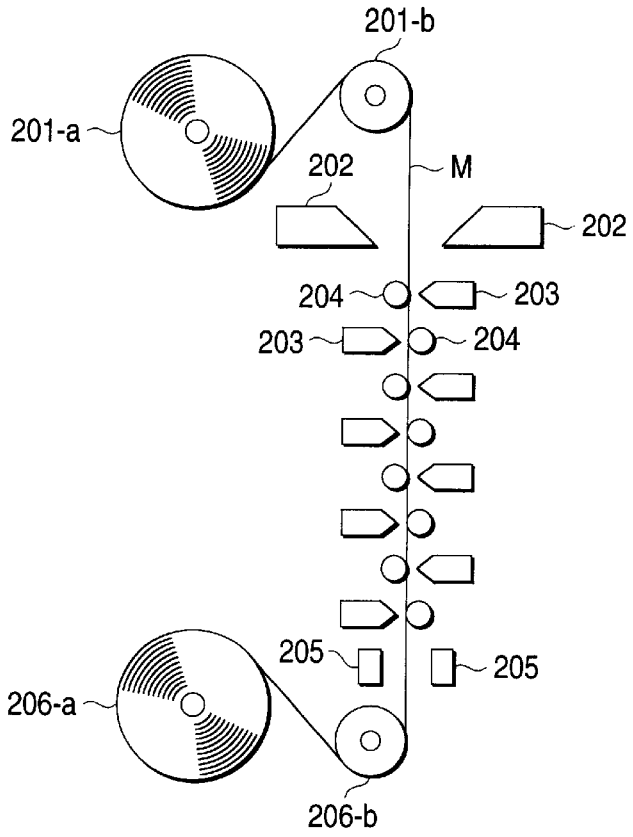
FIG. 17 schematically illustrates another printing apparatus for carrying out the ink jet printing method of the invention.

Ink jet printing was carried out using a printing apparatus shown in FIG. 17 having four ink ejectors 203 for the respective colors (600 dpi full line ink jet heads shown in FIG. 18) arrayed on both sides of a printing medium M. The apparatus of FIG. 17 additionally had a printing medium feed rolls 201-*a* and 201-*b*, a pair of dust removing members 202 (rotary nylon brushes), facing drums 204, a pair of fixing members 205 (Teflon-coated silicone rubber rolls having a 300 W halogen lamp in the core), and a take-up rolls 206-*a* and 206-*b*.

Figure 18:
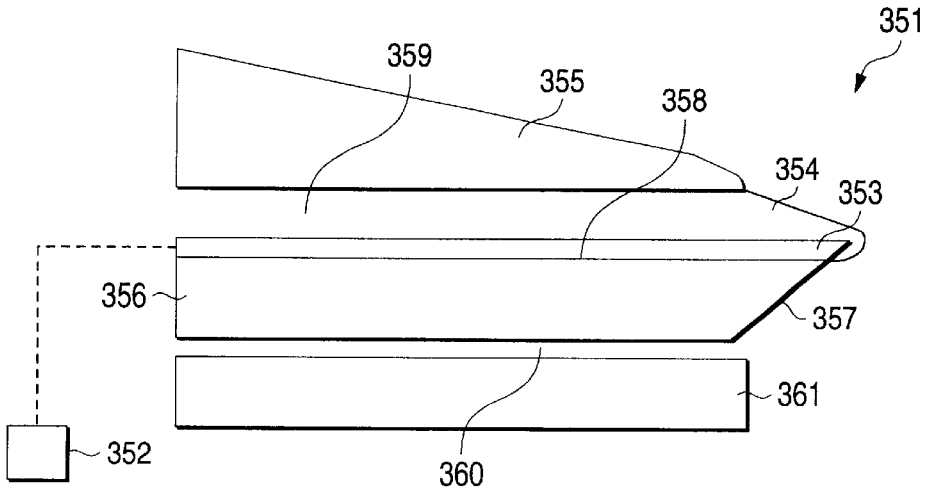
FIG. 18 is a schematic cross-section of an ink jet head used in the printing apparatus of FIG. 17.

The ink jet heads shown in FIG. 18 had an image data computation control 352, an ejection electrode 353, ink 354, an insulating upper plate 355, an insulating lower plate 356 with an upper surface 358 and a tapered surface 357, an ink channel 359, an ink gutter 360, and a backing plate 361. The ink was circulated by means of a pump, which also served for preventing precipitation and coagulation. An ink reservoir was provided between the pump and the ink channel 359 and between the ink gutter 360 and an ink tank, whereby ink was circulated by hydrostatic pressure difference. The ink was maintained at 35° C. by means of a heater, the pump, and a thermostat. A conductivity meter was set in the ink channel 359, and the ink concentration was controlled by dilution or addition of an ink concentrate according to the output of the meter.

Image data to be printed were sent to the image data computation control 352, and the full line heads 203 ejected oily inks onto the printing medium M which was transported between the rotating drums 204 and had been cleared of any dust by the nylon brushes 202. As a result, printing was carried out satisfactorily with no imaging defects due to dust adhesion nor image quality deterioration due to external temperature change or with the increasing number of prints. The ink images were thermally fixed by passing through the fixing members 205 under a pressure of 3 kgf/cm$^2$.

According to the ink jet printing method of the present invention, continuity of tone is secured by setting at least five characteristic curves for a tone conversion table showing the relationship of tone value vs. dot formation energy and by setting at least three characteristic curves each having an energy value other than the maximum and minimum energy values in the half tone range of the tone conversion characteristics.

Further, even when recording pixels of low density are formed on a white background, image graininess can be markedly reduced by setting the number of recorded dots the energy for which is substantially the minimum at or above a half of the total number of the recorded dots at a tone value that is the least of those having a recorded dot the energy for which is substantially the maximum. Thus, the ink jet printing method of the invention is applicable even to printing media that are not always seen as stable in characteristics and is capable of providing high quality prints.

This application is based on Japanese Patent application JP 2001-31149, filed Feb. 7, 2001, the entire content of which is hereby incorporated by reference, the same as if set forth at length.

What is claimed is:

1. An ink jet printing method comprising forming an ink image directly on a printing medium according to image data signals and fixing the image to obtain printed matter, in which tone reproduction is based on conversion of density levels of the image data into sizes of recorded dots, wherein a tone conversion table is prepared based on at least five characteristic curves representing the relationship of tone values versus energy for forming the recorded dots, at least three characteristics curves are prepared each at a prescribed tone value in the half tone range, each having a converted energy value other than the maximum and minimum converted energy values, and the number of recorded dots the converted energy for which is substantially the minimum is a half or more than a half of the total number of the recorded dots at a tone value that is the least of tone values having a recorded dot the converted energy for which is substantially the maximum.

2. The ink jet printing method according to claim 1, wherein the image data are data of a plurality of colors, and at least three periods are used for sub scan for the respective colors so that the positions of recorded dots may be varied among the colors.

3. The ink jet printing method according to claim 1, wherein the relationship between a plurality of recorded dots and the tone conversion characteristic curve per block of an image to be printed varies among a plurality of blocks for at least one color.

4. The ink jet printing method according to claim 3, wherein the at least one color is a color having the lowest density.

5. The ink jet printing method according to claim 4, wherein the one color is yellow.

6. The ink jet printing method according to claim 1, wherein at least two color images have the respective matrices which are different in the number of elements present therein and equal in the horizontal and the vertical lengths, and the relationship between a plurality of recorded dots per matrix and the tone conversion characteristic curve varies among the matrices.

7. The ink jet printing method according to claim 6, in which four color images exist, wherein three of the four color images have the respective matrices which are different in the number of elements present therein and equal in the horizontal and the vertical lengths, and the relationship between a plurality of recorded dots per matrix and the tone conversion characteristic curve varies among the matrices, and one color other than three colors of the three of the four color images is a color having the lowest density.

8. The ink jet printing method according to claim 7, wherein the one color is yellow.

9. An ink jet printing method comprising forming an ink image directly on a printing medium according to image data signals and fixing the image to obtain printed matter, in which tone reproduction is based on conversion of density levels of the image data into sizes of recorded dots, wherein at least two color images have the respective matrices different in the number of elements present therein and equal in the horizontal and the vertical lengths.

* * * * *